United States Patent [19]

Suzuki et al.

[11] Patent Number: 4,954,744

[45] Date of Patent: Sep. 4, 1990

[54] ELECTRON-EMITTING DEVICE AND ELECTRON-BEAM GENERATOR MAKING USE

[75] Inventors: Hidetoshi Suzuki; Ichiro Nomura, both of Atsugi, Japan

[73] Assignee: Canon Kabushiki Kaisha, Tokyo, Japan

[21] Appl. No.: 356,175

[22] Filed: May 24, 1989

[30] Foreign Application Priority Data

May 26, 1988 [JP] Japan ..... 63-126958

[51] Int. Cl.[5] ..... H01J 1/30; H01J 19/10; H01J 19/24

[52] U.S. Cl. ..... 313/336; 313/309; 313/355

[58] Field of Search ..... 313/306, 309, 310, 336, 313/355, 291, 351

[56] References Cited

U.S. PATENT DOCUMENTS

| | | | |
|---|---|---|---|
| 3,970,887 | 7/1976 | Smith et al. | 313/309 |
| 4,728,851 | 3/1988 | Lambe | 313/336 X |
| 4,827,177 | 5/1989 | Lee et al. | 313/336 X |
| 4,855,636 | 8/1989 | Busta et al. | 313/336 X |

*Primary Examiner*—Sandra L. O'Shea

*Attorney, Agent, or Firm*—Fitzpatrick, Cella, Harper & Scinto

[57] ABSTRACT

An electron-emitting device comprises electrodes mutually opposingly provided on the surface of a substrate, and an electron-emitting area provided between the electrodes, wherein a conductive film having an electrical resistance greater than that of said electron-emitting area and not more than $10^{10}\,\Omega$/square is provided on the surface of the substrate at least at the peripheral area of the electron-emitting area in the state that it is electrically connected to said electrodes.

12 Claims, 9 Drawing Sheets

FIG.3—1
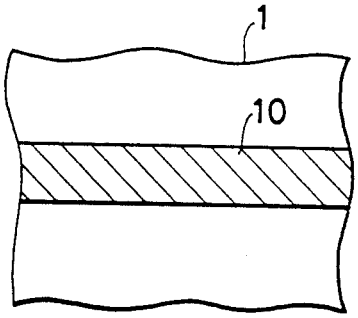
FIG.3—3
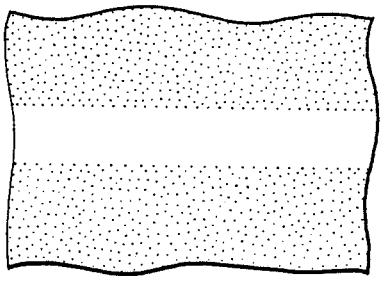
FIG.3—2
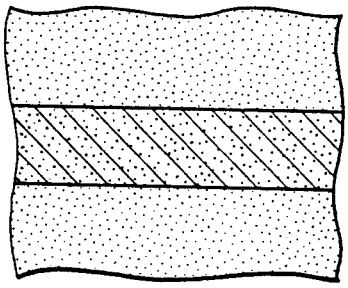
FIG.3—4
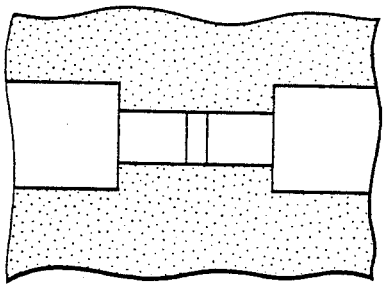

ELECTRON-EMITTING DEVICE AND ELECTRON-BEAM GENERATOR MAKING USE

BACKGROUND OF THE INVENTION

1. Field of the Invention

The present invention relates to an electron-emitting device provided on the surface of a substrate, and an electron-beam generator equipped with the device.

2. Related Background Art

Hitherto known as a device achievable of emitting electrons with use of a simple structure is the cold cathode device published by M. I. Elinson et al (Radio Eng. Electron. Phys., Vol. 10, pp. 1290–1296, 1965.

This utilizes the phenomenon in which electron emission is caused by flowing an electric current to a thin film formed with a small area on a insulating substrate and in parallel to the surface of the film, and is generally called the surface conduction type electron emission device.

This surface conduction type electron emission device that has been reported includes those employing a $SnO_2(Sb)$ thin film developed by Elinson et al named in the above, those comprising an Au film (G. Dittmer, "Thin Solid Films", Vol. 9, p. 317, 1972), those comprising an ITO thin film (M. Hartwell and C. G. Fonstad, "IEEE Trans. ED Conf.", p. 519, 1975), and those comprising a carbon thin film [Hisa Araki et al., "SHINKU (Vacuum)", Vol. 26, No. 1, p.22, 1983].

These surface conduction type electron emission devices have the advantages that;

(1) they can achieve a high electron-emission efficiency;
(2) they are simple in construction and hence can be manufactured with ease;
(3) a number of devices can be formed by arranging them on the same substrate;
(4) they can attain a high speed of response; and so forth and can henceforth promise to be widely applied.

However, in the conventional electron-emitting devices, the insulating substrate on which the electron-emitting device is formed has an unstable potential, causing the problem that the orbits of the electrons emitted become unsteady.

FIG. 1 shows an example to explain this problem, and partially illustrates a display unit in which a conventional surface conductance electron-emitting device is applied. The numeral 1 denotes an insulating substrate made of, for example, glass; and 2 to 5, component elements of the surface conduction type electron emission device, where the numeral 2 denotes a thin film made of a metal or a metal oxide, or carbon, etc., and an electron-emitting area 5 is formed at part thereof by a conventionally known forming treatment. The numerals 3 and 4 denote electrodes provided to apply a voltage to the thin film 2, which are used setting the electrode 3 serving as the positive electrode, and the electrode 4, as the negative electrode. The numeral 6 denotes a glass sheet, on the inner surface of which a phosphor target 8 is provided interposing a transparent electrode 7.

In this unit, the phosphor target 8 can be made to emit light by applying an accelerating voltage of, for example, 10 kV to the transparent electrode 7 and simultaneously applying a given voltage between the electrodes 3 and 4 of the surface conduction type electron emission device, thereby effecting emission of electron beams.

In the case of this unit, however, the orbits of the electron beams is not necessarily steady to cause a change of the shapes of luminescent spots on the phosphor target, resulting in a lowering of the quality level of a displayed image to bring about a serious difficulty.

This is because the substrate 1 in which the surface conduction type electron emission device is provided has so an unstable potential that the electron beams therefrom are adversely influenced. In particular, the potential at the peripheral area of the electron-emitting area 5, as shown by a shaded portion in the figure, greatly influence the orbits of electron beams. Such a difficulty has been caused even in other units having a different construction from that of FIG. 1, for example, a display unit comprising an electrode additionally provided between the electron-emitting device and the transparent electrode 7, for the purpose of the draw-out, strength modulation or deflection of electron beams, or an electron beam drawing unit equipped with an image forming material other than the phosphor as the target of electron beams.

SUMMARY OF THE INVENTION

An object of the present invention is to provide an electron-emitting device suffering very little fluctuation (or unsteadiness) of the electron beams emitted, and capable of giving a steady electron beam orbit, and an electron-beam generator making use of the device.

To achieve the above object, the present invention provides an electron-emitting device, comprising electrodes mutually opposingly provided on the surface of a substrate, and an electron-emitting area provided between said electrodes, wherein a conductive film having an electrical resistance greater than that of said electron-emitting area and not more than $10^{10}$ Ω/square is provided on the surface of the substrate at least at the peripheral area of said electron-emitting area in the state that it is electrically connected to said electrodes.

The present invention also provides an electron-beam generator, comprising electrodes mutually opposingly provided on the surface of a substrate; an electron-emitting area provided between said electrodes; a conductive film having an electrical resistance greater than that of said electron-emitting area and not more than $10^{10}$ Ω/square, provided on the surface of the substrate at least at the peripheral area of said electron-emitting area in the state that it is electrically connected to said electrodes; and an electric source for applying a voltage between said electrode.

BRIEF DESCRIPTION OF THE DRAWINGS

FIGS. 2-1A, 2-1B; 2-2 to 2-4 are plan views serving to describe the electron-emitting device of the present invention, in which FIGS. 2-1A and 2-1B illustrate instances in which the present invention is not embodied, and FIGS. 2-2 to 2-4 illustrate various embodiments of the present invention;

FIGS. 3-1 to 3-4 are views to show the procedures for preparing the device of the embodiment illustrated in FIG. 2-4;

FIGS. 4 to 6 are views to show midway steps for the process of preparing the electron-emitting device according to the present invention;

DETAILED DESCRIPTION OF THE INVENTION

Figure 1:
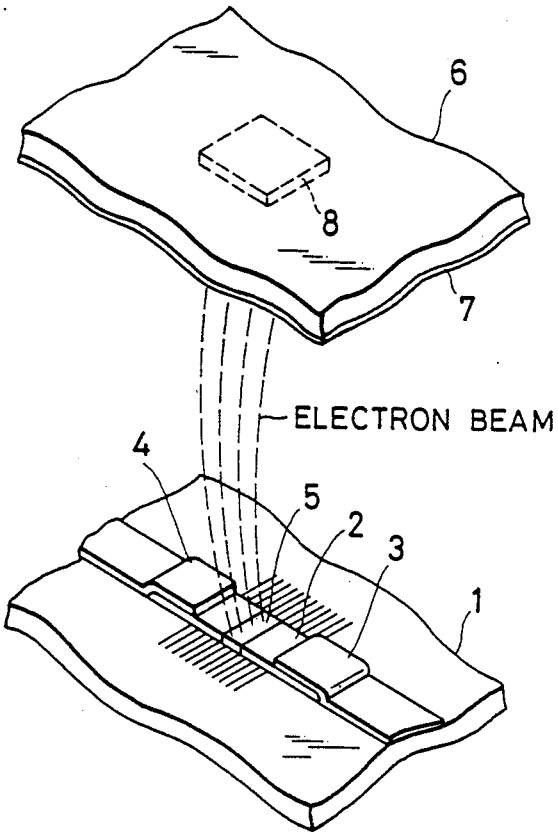
FIG. 1 is a perspective view of a conventional display unit.

The present invention are an electron-emitting device, comprising electrodes mutually opposingly provided on the surface of a substrate, and an electron-emitting area provided between said electrodes, wherein a conductive film having an electrical resistance greater than that of said electron-emitting area and not more than $10^{10}$ Ω/square is provided on the surface of the substrate at least at the peripheral area of said electron-emitting area in the state that it is electrically connected to said electrodes; and an electron-beam generator, comprising an electric source for applying a voltage between the electrodes of said electron-emitting device. The electron-emitting device and the electron-beam generator can afford to achieve a stable surface potential of the substrate and steady orbits of electron beams.

As the above conductive film, at least one material can be used selected from the group of materials consisting of borides, carbides, nitrides, metals, metal oxides, semiconductors and carbon.

Of the above materials, in instances in which materials having a specific resistance of not less than $1\times10^4$ Ω·cm and not more than $1\times10^7$ Ω·cm, including a part of oxides, as exemplified by NiO, SiC and $V_2O_5$ are used as the material for the conductive film, the material is formed into a continuous film, and the film may have a suitable film thickness t (cm) which is determined by the following relationship (1):

$$\rho/R_d > t > \rho\cdot10^{-10}$$

wherein ρ represents specific resistance (Ω·cm) of the material used, and $R_d$ represents a sheet resistance (Ω/square) of the electron-emitting area.

Of the above material, in instances in which materials having a specific resistance resistance ρ less than $1\times10^4$ Ω·cm, including metals, a part of borides, a part of carbides, a part of nitrides, a part of oxides and a part of semiconductors are used as the material for the conductive film, as exemplified by borides such as $LaB_6$, $CeB_6$, $YB_4$ and $GdB_4$, carbides such as TiC, ZrC, HfC, TaC and WC, nitrides such as TiN, ZrN and HfN, metals such as Nb, Mo, Rh, Hf, Ta, W, Re, Ir, Pt, Ti, Au, Ag, Cu, Cr, Al, Co, Ni, Fe, Pb, Pd, Cs, Mg and Ba, metal oxides such as $In_2O_3$, $SnO_2$ and $Sb_2O_3$, semiconductors such as Si and Ge containing impurities, and carbon, the material is formed into a discontinuous film in which said material is dispersed in the form of fine particles.

In particular, materials having the same composition as the material that forms electron-emitting area of the electron-emitting device may be used as the material that forms the discontinuous film, so that the characteristics of the electron-emitting device may not be adversely affected, also making it easy to prepare the device.

In the same above, way, the density of fine particles may be appropriately selected, whereby the resistance of the substrate surface can be controlled to be an appropriate value. In the present invention, the thin film may particularly preferably have an electrical resistance of from $1\times10^8$ Ω/square to $1\times10^{10}$ Ω/square.

A method of forming the above conductive film will be described below.

First, to form the conductive film having the electrical resistance greater than the electron-emitting area and not more than $10^{10}$ Ω/square by using the material having its specific resistance ρ of from $1\times10^4$ to $1\times10^7$ Ω·cm as the material for the conductive film, as exemplified by NiO, SiC and $V_2O_5$, a continuous film is formed by a vacuum deposition process such as EB deposition, sputtering, and heat deposition to have the film thickness t satisfying the above relationship (1). Such film formation may be carried out after the electrodes and electron-emitting area have been provided on the substrate surface, or the conductive film may have been formed before the electrodes and electron-emitting area are formed on the substrate surface. The conductive film obtained after the film formation is patterned with a desired shape by a patterning technique such as photolithographic etching and lifting off. Alternatively, besides the photolithographic etching and lifting-off, the film formation can also be carried out by masked deposition or the like process, making it possible to reduce the number of processing steps.

Next, to form the conductive film having the electrical resistance greater than the electron-emitting area and not more than $10^{10}$ Ω/square by using the material having its specific resistance ρ of less than $1\times10^4$ Ω·cm as the material for the conductive film, as exemplified by borides such as $LaB_6$, $CeB_6$, $YB_4$ and $GdB_4$, carbides such as TiC, ZrC, HfC, TaC and WC, nitrides such as TiN, ZrN and HfN, metals such as Nb, Mo, Rh, Hf, Ta, W, Re, Ir, Pt, Ti, Au, Ag, Cu, Cr, Al, Co, Ni, Fe, Pb, Pd, Cs, Mg and Ba, metal oxides such as $In_2O_3$, $SnO_2$ and $Sb_2O_3$, semiconductors such as Si and Ge containing impurities, and carbon, the material is formed into a discontinuous film by a coating method such as dipping, spin coating and spray coating, using a dispersion obtained by dispersing the material in the form of fine particles. In this instance, the density of fine particles in the discontinuous film may be appropriately determined depending on the materials used. Also in the instance where the vacuum deposition process is used, the desired discontinuous film can be obtained if the film at the initial stage of the deposition is used.

In the present embodiment also, the film formation may be carried out after the electrodes and electron-emitting area have been provided on the substrate surface or before the electrodes and electron-emitting area are formed on the substrate surface. The patterning of the film is also carried out in the same manner as the continuous film described above.

The electron-emitting device of the present invention comprises the electron-emitting area, which may be formed by a conventional forming treatment (FIG. 2-1A) or by dispersing fine particles (FIG. 2-1B) without carrying out the forming treatment, and can be satisfactory if it has the form that enables emission of electron beams by applying a suitable voltage to the electron-emitting area. Materials used in the electron-emitting area may specifically include borides such as $LaB_6$, $CeB_6$, $YB_4$ and $GdB_4$, carbides such as TiC, ZrC, HfC, TaC, SiC and WC, nitrides such as Tin, ZrN and HfN, metals such as Nb, Mo, Rh, Hf, Ta, W, Re, Ir, Pt, Ti, Au, Ag, Cu, Cr, Al, Co, Ni, Fe, Pb, Pd, Cs, Mg and Ba, metal oxides such as $In_2O_3$, $SnO_2$ and $Sb_2O_3$, semiconductors such as Si and Ge, and carbon. From the viewpoint of electron-emitting efficiency, it is desirable to subject the film comprised of any of these materials to forming treatment, or disperse these materials in the form of fine particles between the electrodes, thereby forming the electron-emitting area having an electrical resistance particularly preferably of from $1\times10^4$ Ω/square to $1\times10^7$ Ω/square.

The present invention will now be specifically described with reference to the drawings.

FIGS. 2-1A to 2-4 are views serving to describe the present invention, and show plan views of the electron-emitting device. Here, an insulator is mainly used as the substrate. The present invention can be widely applied in electron-emitting devices and electron-beam generators comprising the electron-emitting devices.

Figure 2:
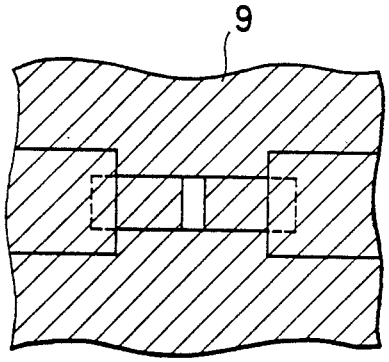
Figures 1A, 2:
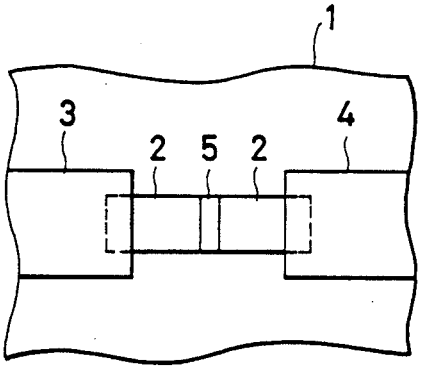

FIG. 2-1A shows a state in which the covering with the conductive film characterized in the present invention has not been carries out. The numeral 1 denotes a substrate made of an insulator as exemplified by glass, and the numerals 2 to 5 denote component elements of the surface conduction type electron emission device, where the numeral 2 denotes a thin film made of several or a metal oxide, or carbon, etc., and an electron-emitting area 5 is formed at part thereof by a conventionally known forming treatment. The electron-emitting area 5 has, in general, a surface resistance of not more than $10^7$ Ω/square, which is variable depending on materials used or conditions for the forming treatment. The numerals 3 and 4 denote electrodes provided to apply a voltage to the thin film 2, which are used setting the electrodes 3 serving as the positive electrode, and the electrode 4, as the negative electrode, and the voltage is applied between both the electrodes through an electric source (not shown).

Illustrated in FIG. 2-2 is an embodiment in which the above insulating substrate of the surface conduction type electron emission device is covered with the conductive film. In FIG. 2-2, the shaded portion 9 shows the part covered with the film. Being covered in the manner as illustrated in FIG. 2-2, the conductive film with which the substrate is covered is electrically connected to a positive electrode 3 and a negative electrode 4 of the electron-emitting device.

Used as covering materials (thin-film materials) are materials having a higher conductivity than the material for the insulating substrate, as exemplified by metals such as Au, Pt, Ag, Cu, W, Ni, Mo, Ti, Ta and Cr, metal oxides such as $SnO_2$ and ITO, as well as carbides, borides, nitrides, semiconductors, and carbon.

Of these materials, in instances in which those having a specific resistance of not more than $1\times10^4$ Ω·cm is used, the material is dispersedly arranged in the form of fine particles on the substrate to form a discontinuous thin film. On the other hand, of these, in regard to the materials having a specific resistance of not less than $1\times10^4$ Ω·cm and not more than $1\times10^7$ Ω·cm, a continuous film having the film thickness ti represented by the relationship (1) previously described is provided to cover the shaded portion 9.

Such covering results in a potential distribution always constant at the peripheral area of the electron-emitting area 5. More specifically, assuming the potential applied to the positive electrode 3 as $V_3$ and the potential applied to the negative electrode 4 as $V_4$ when electron beams are generated from the electron-emitting device, the potential $V_s$ on the surface of the substrate at the peripheral area of the electron-emitting area 5 is distributed within the range of $V_3 \geqq V_s \geqq V_4 (V_3 > V_4)$. Hence, the fluctuation of the orbits of electron beams can be remarkably decreased as compared with the instance in which the substrate at the peripheral area of the electron-emitting area 5 is in an electrically floating state as in the device of FIG. 2-1.

On this occasion, an electric current is flowed between the positive electrode 3 and negative electrode 4 at the above shaded, or covered, area 9. The electric power consumed at this area, however, does not contribute to the emission of electron beams, and therefore should preferably be as small as possible.

Figures 2, 3:
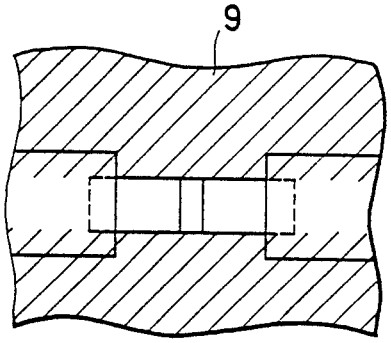

Illustrated in FIG. 2-3 is an embodiment in which the shaded portion 9 is covered with the conductive-film material in the same way as in the above embodiment of FIG. 2-2, and this is greatly effective for making steady the orbits or electron beams as in the embodiment of FIG. 2-2. The covering in the form as in the present embodiment enables preparation of the film not only by the photolithographic etching or lifting-off but also the masked deposition, making it possible to reduce the number of processing steps.

In the foregoing description relating to FIGS. 2-2 and 2-3, description is made about the instance in which the conductive film 2 of the electron-emitting device is previously subjected to forming treatment to form the electron-emitting area 5 followed by covering with the conductive-film material, but the device may not necessarily be prepared following this procedure. Namely, the thin film 2 may be first formed on the substrate 1, followed by covering with the conductive-film material, and further followed by the forming treatment to form the electron-emitting area 5. In such an instance, the thin film 2 is heated and the surrounding area thereof is also heated to a relatively high temperature in the step of carrying out the forming treatment. Taking account of this, a high-melting material as exemplified by W, Ta, C, Ti and Pd may be used as the covering material, so that the orbits of electron beams can be made steady without causing any contamination that may adversely affect the characteristics of the electron-emitting device. Even if the high-melting material is not used, very stable characteristics can be obtained also when the substrate is covered with a material having the same composition as the thin film 2. This is presumably for the reason that, because of the material having the same composition, no contamination that may adversely affect the surface of the electron-emitting area 5 is not generated even when a part of the covering material has been melted or evaporated as a result of the high temperature.

Figures 1B, 2:
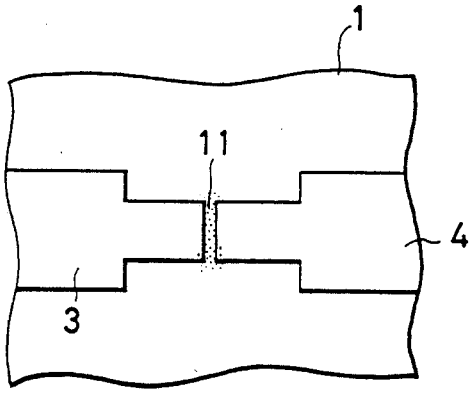
Figures 2, 3, 4:
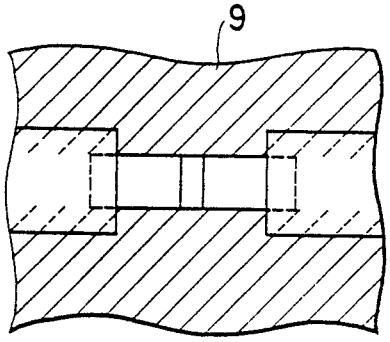
Figure 4:
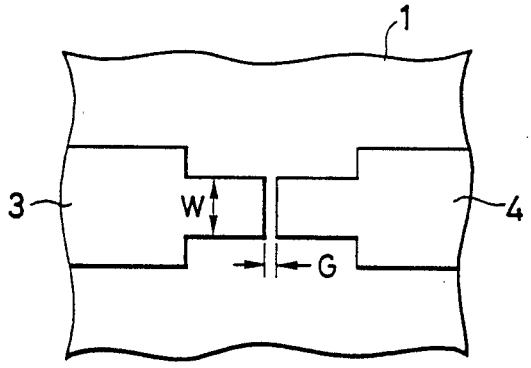

As another procedures to prepare the electron-emitting device, it may be formed after the insulating substrate has been covered with the conductive-film material, and, for example, the embodiment as illustrative in FIG. 2-4 may be taken to obtain good characteristics. (In the drawing, the portions shaded with dotted lines show areas covered with the electrode 3 and electrode 4.) The device of the present embodiment is prepared, for example, by the following procedures:

First, as illustrated in FIG. 3-1, a photoresist pattern 10 is formed on the insulating substrate 1 comprising glass, ceramics or the like. Next, as illustrated in FIG. 3-2, the above substrate is covered with the conductive-film material on its whole surface. The covering is carried out be coating with a dispersion obtained by dispersing fine particles of the conductive-film material. For example, the fine particles and an additive capable of accelerating the dispersion of the fine particles are added in an organic solvent comprising butyl acetate or alcohol, following by stirring and so on to prepare the dispersion of fine particles. This fine particle dispersion is applied by dipping, spin coating or spraying, followed by heating at a temperature at which the solvent and so fourth are evaporated, for example, at 250° C. for 10 minutes, and thus the fine particles are dispersedly arranged.

The method of dispersedly arranging the fine particles includes, in addition to the above formation by coating, a method in which, for example, a solution of an organic metal compound is applied on the substrate, followed by thermal decompositioned to form the fine particles thereon. In regard to materials feasible for vacuum deposition, the fine particles can also be formed by controlling deposition conditions such as substrate temperature or employing a vacuum deposition method such as masked deposition.

Next, as illustrated in FIG. 3-3, the surface of the substrate is exposed in part by the lifting-off of the photoresist pattern 10.

In order to firmly fix on the substrate surface the above fine particles dispersedly arranged, for example, a mixture prepared by mixing fine particles of a low-melting frit glass into the above fine particle dispersion may be applied on the surface, followed by baking at temperatures higher than the softening point of the low-melting frit glass.

Alternatively, before the fine particles are dispersedly arranged, the low-melting frit glass may be previously applied on the substrate 1 to provide a subbing layer, and then the fine particles are applied, followed by baking.

On this occasion, a liquid coating insulating layer (as exemplified by Tokyo Ohka OCD; an $SiO_2$ insulating layer) may be used in place of the low-melting frit glass.

Then the thin film 2 of the electron-emitting device is formed, the electrode 3 and electode 4 are further formed, and finally the forming is carried out to form the electron-emitting area 5.

The device of the embodiment of FIG. 2-4 can be prepared according to the above procedures.

As described in the above, the surface of the insulating substrate on which the electron-emitting device has been formed is covered with the conductive film so as to give an electrical resistance greater than that of the electron-emitting area of the electron-emitting device and not more than $10^{10}$ Ω/square and said conductive film is electrically connected to the electrodes of the electron-emitting device, whereby the surface potential of the substrate can be brought into not a floating state but a given distributed state. As a result, the orbits of electron beams can be made very steady.

In that instance, by appropriately selecting the materials used in the conductive film, the surface resistance of the insulating substrate can be lowered to a suitable value without giving any adverse influence to the characteristics of the electron-emitting device.

The embodiment described above is an example in which the present invention is applied in the surface conduction type electron emission device that requires the forming process in forming the electron-emitting area. However, the present invention can also be applied in a device that requires no forming process, as exemplified by the following.

Figure 5:
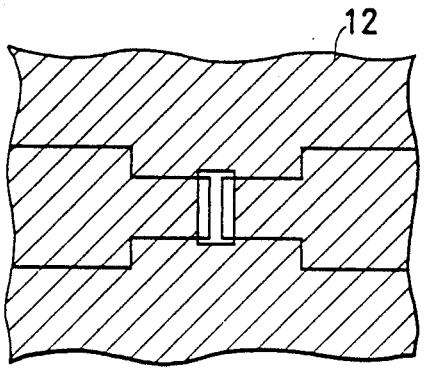
Figure 6:
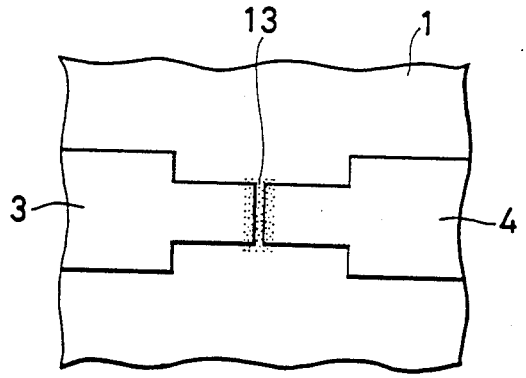
Figure 7:
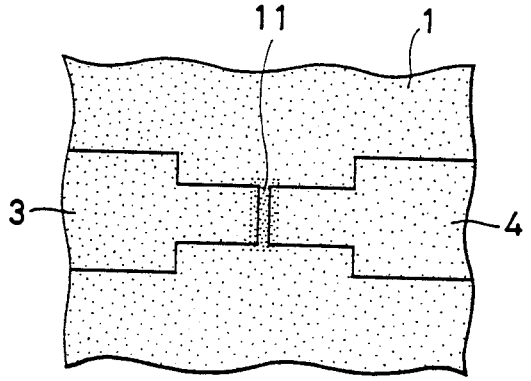
FIG. 7 illustrates a first embodiment of the present invention.

FIGS. 4 to 7 are plan views serving to describe another embodiment of the present invention, i.e., an embodiment in which device that requires no forming process is used. FIG. 4 shows the dimension of the device, FIGS. 5 and 6 illustrate midway steps for the manufacture, and FIG. 7 illustrates a form of a completed device.

In FIG. 4, the numeral 1 denotes an insulating substrate made of glass, ceramics or the like, and a positive electrode 3 and negative electrode 4 are provided on the substrate. The electrodes 3 and 4 can be readily formed by vacuum deposition and photolithographic etching or lifting-off, or printing, which are hitherto known in the art. Usable as materials for electrodes are commonly available conductive materials, and metals such as Au, Pt and Ag, as well as oxide conductive materials such as $SnO_2$ and ITO.

The electrodes 3 and 4 may each have a thickness of from several hundred Å to several μm in approximation, which are appropriate values, but by no means limited thereto. As the dimension of the gap G between electrodes, the electrodes may be opposed with a gap of appropriately from several hundred Å to several ten μm, and with a gap width W of appropriately from several μm to several mm in approximation, which, however, are by no means limited to these dimensional values.

The region W×G defined between the positive electrode 3 and negative electrode 4 is covered with a fine particles of electron emitting material as will be detailed below, so as to have a surface resistance of from $1\times10^4$ to $1\times10^7$ Ω/square in approximantion, and thus the electron-emitting area is formed at this region. The substrate surface other than the above region W×G is covered with the conductive-film material so as to have an electrical resistance greater than that of the electron-emitting area and not more than $1'10^{10}$ Ω/square, and preferably from $1\times10^8$ to $1\times10^{10}$ Ω/square in approximation. Procedures therefor will be described below.

Illustrated in FIG. 5 is a device in which a photoresist pattern 12 is formed in the above substrate shown in FIG. 4, and an aperture is made on the above region W×G. This aperture may have dimensions identical to the region W×G when no misregister may occur at all, but, in the present embodiment, the aperture is made to have slightly larger dimensions to made easy the manufacture.

Next, the substrate shown in FIG. 5 is covered with the electron emitting material having a higher conductivity than the substrate. Here, the covering may not necessarily refer to a state wherein the surface is covered in its entirety, and may also refer to a state wherein the fine particles of the electron emitting material are dispersedly arranged in a discontinuous fashion with appropriate intervals.

Specifically stated, the covering is carried out using, for example, a dispersion comprising fine particles of the electron emitting material. For example, the fine particles and an additive capable of accelerating the dispersion of the fine particles are added in an organic solvent comprising alcohol or the like, followed by stirring and so on to prepare the dispersion of fine particles. This fine particle dispersion is applied by coating or spraying, or the substrate is dipped into the fine particle dispersion, followed by keeping at a temperature at which the solvent and so forth are evaporated, for example, at 140° C. for 10 minutes, and thus the electron emitting material is dispersedly arranged with appropriate intervals.

Materials for the fine particles used herein extend over a very wide range, and there can be used those having a specific resistance of $\rho < 1\times10^4$ Ω·cm among conductive materials such as usually available metals, semimetals and semiconductors. In particular, preferred are those having the properties of a low work function, a high melting point and at the same time a low vapor pressure. They specifically include, for example, borides such as $LaB_6$, $CeB_6$, $YB_4$ and $GdB_4$, carbides such as TiC, ZrC, HfC, TaC and WC, nitrides such as TiN, ZrN and HfN, metals such as Nb, Mo, Rh, Hf, Ta, W, Re, Ir, Pt, Ti, Au, Ag, Cu, Cr, Al, Co, Ni, Fe, Pb, Pd, Cs, Mg and Ba, metal oxides such as $In_2O_3$, $SnO_2$ and $Sb_2O_3$, semiconductors such as Si and Ge containing impurities, and carbon.

The density with which the fine particles are arranged can be controlled by the preparation of the fine particle dispersion or the number of the coating times. Now, the coating (or dipping) may be carried out in appropriate times and thereafter the above photoresist pattern is lifted off, thus bringing about the state as illustrated in FIG. 6. In this state, the gap area between the positive electrode 3 and negative electrode 4 has a surface resistance greater than the intended resistance of from $1\times10^4$ to $1\times10^7$ Ω/square.

Next, in the same way as done for the substrate of FIG. 5, the whole surface of the substrate of FIG. 6 is covered with the conductive-film material by coating or dipping. The coating (or dipping) may be repeated in appropriate times, thus completing the form as shown in FIG. 7. In FIG. 7, the surrounding of the gap area between the positive electrode 3 and negative electrode 4, which is comprised of the fine particles of the electron emitting material dispersedly arranged with a high density, has a surface resistance of from $1\times10^4$ to $1\times10^7$ Ω/square. The peripheral area thereof, which is comprised of the fine particles of the conductive-film material dispersedly arranged with a relatively low density, has a surface resistance greater than that of the gap area between the electrodes and not more than $1\times10^{10}$ Ωsquare.

In the present embodiment, the aperture in the resist pattern is made larger than the region W×G in the step of FIG. 5, so that the region covered in a high density has a form in which it somewhat extends beyond the gap between the positive and negative electrodes. This, however, caused no deterioration in the emission current quantity or emission efficiency of the electron-emitting device.

Figure 8:
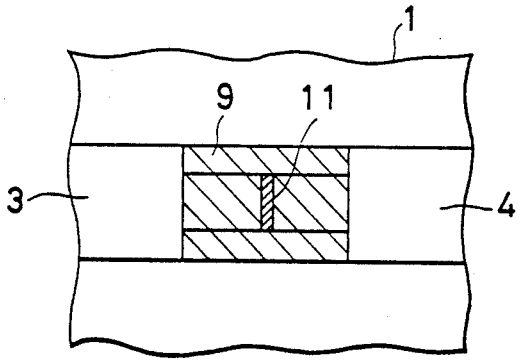
FIGS. 8 and 9 illustrate other embodiments.
Figure 9:
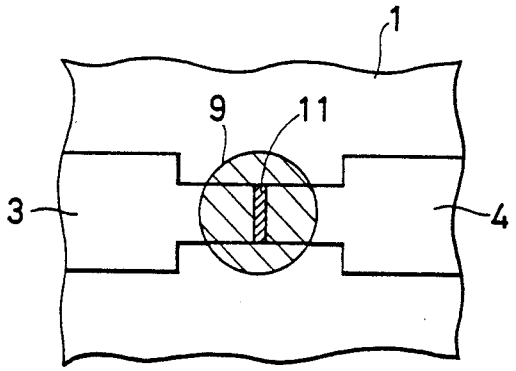

The embodiment of the present invention is by no means necessarily limited to the form itself illustrated in FIG. 7. What influences the orbits of electron beams is primarily the substrate potential at the peripheral area of the electron-emitting area. Accordingly, the whole substrate surface may not be covered with the conductive-film material as illustrated in FIG. 7, and the device may have the form as illustrated in FIG. 8 or 9. In these drawings, the numeral 11 denotes the area having a surface resistance of from $1\times10^4$ to $1\times10^7$ Ω/square preferably; and 9, the area having a surface resistance of from $1\times10^8$ to $1\times10^{10}$ Ω/square (The resistance of the surface of the insulating surface). This embodiment can make smaller the electric power consumed, than the form of FIG. 7.

Figure 10:
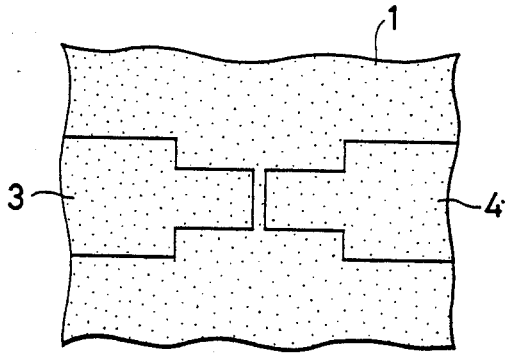
FIGS. 10, 11 and 12 illustrate another preparation process.
Figure 11:
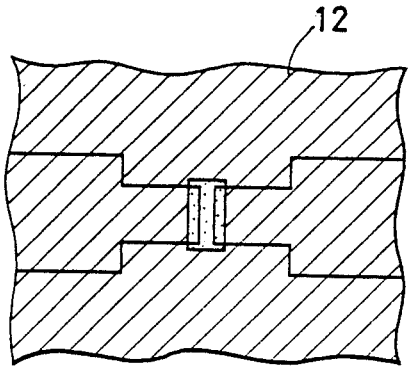

Methods for preparation are also not limited to the processes described with reference to FIGS. 4 to 7, and, as illustrated in FIG. 10, the whole surface of the substrate on which the electrodes 3 and 4 have been formed may be covered with the conductive-film material so as to previously give a surface resistance of from $1\times10^8$ to $1\times10^{10}$ Ω/square in approximation, thereafter a photoresist pattern 12 is formed as illustrated in FIG. 11, the aperture area of the photoresist pattern is further covered with the electron emitting material until it turns to have a surface resistance of from $1\times10^4$ to $1\times10^7$ Ω/square in approximation, and then the photoresist pattern is removed.

Figure 12:
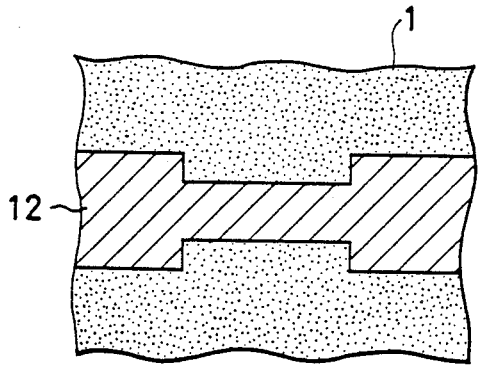
Figure 13:
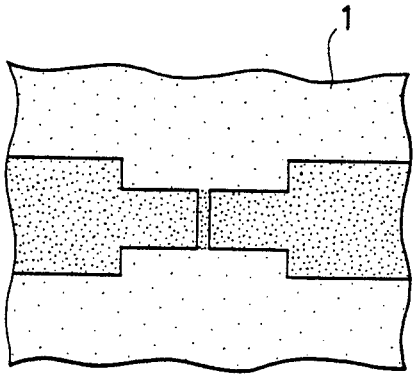
FIGS. 13 illustrates still another embodiment of the electron-emitting device.

Alternatively, the whole surface of the substrate on which the electrodes have been formed may be covered with the electron emitting material to previously give a resistance of from $1\times10^4$ to $1\times10^7$ Ω/square in approximation (the resistance of the surface of the insulating substrate), and thereafter the photoresist pattern 12 is formed as shown by the shaded portion in FIG. 12. Then, using an etchant capable of solving the electron emitting material, etching is carried out until the surface resistance of the exposed area turns to be $1\times10^8$ to $1\times10^{10}$ Ω/square. Thereafter, the photoresist pattern may be removed, thus obtaining the form as illustrated in FIG. 13. This embodiment also can obtain substantially the same performance as that of FIG. 7.

Still alternatively, a process is also feasible in which an water-soluble material (such as polyvinyl alcohol or gelatin) is used in addition to the photoresist, as described below.

Figure 14:
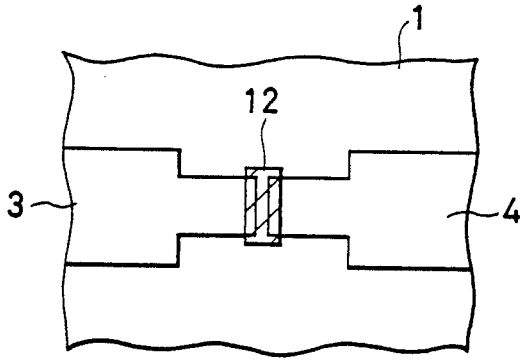
FIGS. 14 and 15 illustrate still another preparation process.
Figure 15:
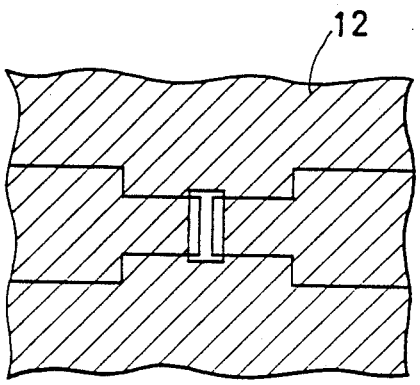

That is to say, a resist pattern 12 as shown in FIG. 14 is first formed, followed by coating with the water-soluble material such as polyvinyl alcohol or gelatin, and the above resist pattern is removed using an organic solvent, thus forming a water-soluble mask pattern 12 as shown in FIG. 15. The subsequent procedures similarly follows as described with reference to the above FIGS. 5 to 7, but the dispersion comprising the conductive-film material, after coating, should preferably be dried at a temperature of about 60° C. In the instance where such a water-soluble mask pattern is used, the degree of freedom of the organic solvent usable in the dispersion of the conductive-film material can be increased, resulting in more readiness of the manufacture.

EXAMPLES

The present invention will now be described below in greater detail by giving Examples.

EXAMPLE 1

An example is first described in which the present invention is applied in the device as illustrated in FIG. 2-1A, i.e., the electron-emitting device such that the forming treatment is applied to the thin film 2 comprising an electron-emitting material to form the electron-emitting area 5.

Stated specifically, on the substrate 1 comprised of a 7059 glass substrate, available from Corning Glass Works, the thin film 2 made of Au is formed with a thickness of about 1,000 Å. Next, the electrodes 3 and 4 for applying a voltage to the thin film 2 are formed. More specifically, thin films made of Ni with a thickness of 1 μm are laminated to form the electrodes 3 and 4, where the electrodes 3 and 4 are each made to be in such a form that part thereof may cover the above thin film 2, thus obtaining electrical contact.

Next, a voltage is applied between the electrodes 3 and 4 to heat the thin film 2, and a conventionally known forming treatment is carried out to cause part of the thin film 2 to undergo a change of properties, thus forming the electron-emitting area 5. Thus the conventionally known surface conduction type electron emission device as illustrated in FIG. 2-1A is completed. In the instance of the surface conduction type electron emission device used in the present Example, comprising Au used as the electron-emitting material, the electron-emitting area 5 had a sheet resistance of from $1\times10^4$ to $1\times10^5$ Ω/square.

A method of covering the glass substrate provided with the above surface conduction type electron emission device, with the conductive film characterized in the present invention, and effect obtainable therefrom will be exemplified below, but an instance will be described first in which $V_2O_5$ having a specific resistance ρapproximately equal to $10^5$ Ω·cm is used as the conductive-film material.

First, the whole surface of the above electron-emitting device was coated with a photoresist, followed by photolithographic etching to remove the resist at areas other than the electron-emitting area 5.

Next, $V_2O_5$ was vacuum deposited by an EB deposition process to give a thickness of 1 μm. Then the resist film remaining on the electron-emitting area 5 was subjected to lifting-of to remove a $V_2O_5$ film at the corresponding part. As a result, a $V_2O_5$ film with a film thickness of 1 μm was formed on the shaded portion 9 shown in FIG. 2-2.

In the present Example, ρ is approximately equal to $10^5$ (Ω·cm), $R_d=1\times10^4$ to $1\times10^5$ (Ω/square), and hence the necessary condition of the film thickness t is:

$$10^{-5}<t<1 \text{ to } 10$$

based on the above relationship (1). Since, however, the covered film has a thickness of 1 μm$=10^{-4}$ cm, this condition is satisfied. However, the specific resistance may sometimes become greater than the value of a bulk material, depending on the film quality of the thin film. On such an occasion, it is necessary to make the film thickness t satisfy the relationship (1) with the specific resistance ascribable to such film quality.

As a result of the covering with the $V_2O_5$ film of 1 μm in film thickness, the substrate comes to have a surface resistance of about $1\times10^9$ Ω/square at the peripheral area of the electron-emitting area 5.

Such covering results in a potential distribution at the peripheral area of the electron-emitting area 5 always constant. More specifically, assuming the potential applied to the positive electrode 3 as $V_3$ and the potential applied to the negative electrode 4 as $V_4$ when the electron beams are generated from the electron-emitting device, the potential $V_s$ on the surface of the substrate at the peripheral area of the electron-emitting area 5 is distributed within the range of $V_3 \geqq V_s \geqq V_4$ ($V_3>V_4$). Hence, the fluctuation of the orbits of electron beams was remarkably decreased as compared with the instance in which the substrate at the peripheral area of the electron-emitting area 5 is in an electrically floating state as in the device of FIG. 2-1. In, for example, the above display unit as illustrated in FIG. 1, the orbits of electron beams were not steady before the present invention was applied, so that the luminescent spot on the phosphor target 8 was not fixed. When the positional change of the luminescent spot was caused at a relatively high rate, the region of about 3 mm in diameter was visually observed as if it emitted light.

However, as a result of application of the present invention, the fluctuation of the orbits of electron beams was remarkably decreased, so that the luminescent spot of about 700 μm in diameter was observed to be stationary on the phosphor target 8.

As a result, when an image was displayed, the image had sharp edges with an improved image quality level, making it possible to realize a display unit having a higher resolution.

On this occasion, at the above covered area 9, an electric current is flowed between the positive electrode 3 and negative electrode 4, but the electric power consumed at this area does not contribute the emission of electron beams, and therefore should preferably be as small as possible. According to experiments carried out by the present inventors, the electric power consumed at the above $V_2O_5$ film was found to be as good as 1/100 or less of the electric power consumed at the electron-emitting device.

In the instance where the above surface conduction type electron emission device comprising Au used as the electron-emitting material was covered with the $V_2O_5$ film of 1 μm in film thickness on the region shown by the shaded portion 9 in FIG. 2-3, there was also seen a very great effect in making the orbits of electron beams steady, which was quite as great as that of the device of FIG. 2-2. In the instance where the device has the form as shown in FIG. 2-3, the conductive film 9 had so a simple pattern form that it was possible to prepare the device not only by the lifting-off previously described with reference to the preparation process concerning the device of FIG. 2-2, but also by the masked deposition.

In the instance where the above surface conduction type electron emission device comprising Au used as the electron-emitting material was covered with the $V_2O_5$ film of 1 μm in film thickness on the region shown by the shaded portion 9 in FIG. 2-4, there was also seen a very great effect in making the orbits of electron beams steady, which was quite as great as that of the device of FIG. 2-2. In this instance, the device was prepared by carrying out the film formation in the order of the Au thin film, $V_2O_5$ film, and Ni thin film, but there was exhibited substantially the same performance as the above example concerning FIG. 2-3 in respect of the effect of making the orbits of electron beams steady and also in respect of the smallness of the electric power consumed.

Examples in which the continuous film made of $V_2O_5$, having a film thickness of 1 μm, were described above, but a very great effect in making the orbits of electron beams steady was seen also in instances where, for example, an NiO thin film with a film thickness of about 1,000 Å or an SiC thin film with a film thickness of about 1 μm was used in place of the $V_2O_5$ thin film.

EXAMPLE 2

An example will be next described in which a glass substrate provided with the same surface conduction type electron emission device comprising Au used as the electron-emitting material as in Example 1 was covered with a discontinuous film of Pd in place of the $V_2O_5$ thin film. The discontinuous film was formed by a method comprising coating the substrate with a solution obtained by dispersing Pd particles, followed by drying. The electrical resistance on the surface of the glass substrate on which this discontinuous film is formed can be controlled by the concentration of the fine particle dispersion or the number of coating times.

For example, in an instance where a palladium fine particle dispersion (trade name: CCP4230; available from Okuno Chemical Industries, Co., Ltd.) is applied on a glass substrate by spin coating, the surface resistance can be varied in the following way according to the number of times of the coating. Namely, CCP4230 is dropped in an appropriate amount on a glass substrate set on a spinner, which is thereafter immediately rotated at 300 rpm for 60 seconds and subsequently at 1,000 rpm for 2 seconds, followed by drying. When this operation was repeated 20 times, the surface resistance came to be about $1.5\times10^7$ Ω/square; when repeated 30 times, about $3\times10^5$ Ω/square; when repeated 40 times, about $7.5\times10^4$ Ω/square. When the fine particle dispersion is diluted with a solvent to lower the concentration of the fine particles, the variation quantity of the surface resistance per one time of coating is small, and, on the other hand, when a dispersion with a high concentration of the fine particles is used, the variation quantity of the surface resistance per one time of coating becomes large.

Now, the present inventors applied a photoresist on the whole surface of the electron-emitting device having the form as shown in the above FIG. 2-1A, thereafter removed the resist at the part other than the electron-emitting area 5 by photolithographic etching, and then repeated 20 times the operation of applying the above palladium dispersion. Next, the resist film remaining on the electron-emitting area 5 was removed, and thus a discontinuous film comprising palladium fine particles was formed on the part shown by the shaded portion 9 in FIG. 2-2. Here, the surface of the glass substrate covered with the discontinuous film had a sheet resistance of from $10^8$ Ω/square to $10^9$ Ω/square. This is presumably because a part of the palladium fine particles was lost in the last step of removing the resist film.

In the present Example also, there was achieved a great effect of making the orbits of electron beams steady, like the instance where the substrate was covered with the $V_2O_5$ continuous film as mentioned above, and the luminescent spot on the fluorescent screen was kept very steady when the device was applied in a display unit, as compared with the instance where the substrate was not covered with the palladium discontinuous film. And the consumed electric powder having increased as a result of covering with the palladium discontinuous film was only 1/100 or less.

Like the instance of the $V_2O_5$ continuous film in Example 1, it was possible to carry out covering in the form as shown in FIG. 2-3 or 2-4 also when the discontinuous film of palladium fine particles was formed, and it was able to greatly decrease the fluctuation of the orbits of electron beams in each instance. In the instance of the covering in the form as shown in FIG. 2-3, the palladium discontinuous film was formed following the process as shown in FIGS. 3-1 to 3-4. More specifically, as illustrated in FIG. 3-1, the photoresist pattern 10 was formed on a glass substrate 1 comprising 7059 glass, available from Corning Glass Works. Next, as illustrated in FIG. 3-2, a palladium dispersion CCP4230, available from Okuno Chemical Industries, Co., Ltd., was applied by spin coating on the whole surface of the above substrate. (The spin coating was carried out under the same conditions as those in the instance where the device was prepared in the form as shown in FIG. 2-2.)

Next, as illustrated in FIG. 3-3, the photoresist pattern 10 was removed and then the Au thin film 2, Ni electrodes 3 and 4 were formed in this order by masked deposition. Then a voltage was applied between the electrodes 3 and 4 to carry out forming treatment by heating under excitation, thus completing the form as shown in FIG. 3-4. In the course of the above forming treatment, the Au thin film 2 was heated, resulting in a relatively high temperature at the peripheral area thereof, but, because of a higher melting point of Pd than Au, there was caused no contamination that may deteriorate the characteristics of the electron-emitting device.

In the present Example, the discontinuous film 9 was formed by applying the palladium fine particle dispersion, but it is also possible to form the discontinuous film with a prescribed surface resistance by using other materials, as exemplified by the following.

A fine particle dispersion was prepared by adding 1 g of $SnO_2$ fine particles (trade name: ELCOM-TL 30; available from Skokubai Kasei Kogyo K.K.) and 1 g of butyral in 100 cc of MEK, stirring the mixture in a paint shaker, and diluting the resulting mixed colloids to 1/100 using MEK. Then the spin coating was carried out under the same revolving conditions as those for the above palladium dispersion. When the coating was carried out 10 times, the surface resistance was about $5\times10^8$ Ω/square, and it was possible to obtain the desired surface resistance by varying the concentration of the dispersion and the number of coating times. Now, the discontinuous film was provided by coating, for example, on the device of the above form as shown in FIG. 2-2, and the resistance of the glass substrate surface was made to be about $1>10^9$ Ω/square. As a result, the orbits of electron means became very steady.

The above Example is concerned with examples in which the present invention is applied in the electron-emitting device having the form as shown in FIG. 2-1A and corresponding Au used as the electron-emitting material. However, the effect of making the orbits of electron beams steady was confirmed to be obtainable also when a device comprising a material other than Au, as exemplified by ITO or carbon, used as the electron-emitting material was covered with the above continuous film or the above discontinuous film.

EXAMPLE 3

An example will be described below in which the present invention is applied to the electron-emitting device as illustrated in FIG. 2-1B.

As illustrated in FIG. 4, Ni electrodes 3 and 4 with a thickness of about 1 μm each were formed on the glass substrate 1 made of 7059 glass, available from Corning Glass Works. The part at which the electrodes 3 and 4 are opposed was made to have the shape with dimensions of W=300 μm and G=2 μm.

Next, the whole surface of the substrate was coated with a photoresist and photolithographic etching was carried out to cover with a resist film the region shown by the shaded portion 12 in FIG. 5.

Next, the operation to coat the substrate with the above palladium dispersion CCP4230 was repeated 20 times, and thereafter the resist film was removed to bring the substrate into the state as illustrated in FIG. 6. Here, the glass substrate surface at the region 13 applied with the palladium fine particles had a resistance of from $1.5\times10^{-7}$ to $5\times10^{-7}$ Ω/square in approximation.

Next, the palladium dispersion was applied on the whole surface of the substrate 15 times to complete the form as shown in FIG. 7, where the electron-emitting area 11 has an electrical resistance of about $1\times10^5$ Ω/square and the surface of the glass substrate at the peripheral area thereof had an electrical resistance of about $3\times10^8$ Ω/square.

The electron-emitting device of the present Example was applied to the above display unit of FIG. 1. As a result, the orbits of electron beams were made steady as compared with the instance where the device of FIG. 2-1B, in which the present invention is not embodied, is used, so that the luminescent spot on the fluorescent screen was not fluctuated and a good display performance was obtained. The consumed electric power also increased by 1/50 or less as compared with the device of FIG. 2-1B.

The device may also be covered at its peripheral area with a photoresist pattern between the steps shown by FIGS. 6 and 7, and thus the part covered with the palladium discontinuous film can also be made to have the shape as that of the shaded portion 9 in FIG. 8 or 9. In an experiment made by the present inventors, the region of 2 mm in radius from the center of the electron-emitting area 11 was covered with the above discontinuous film with the shape as shown in FIG. 9. As a result, there was seen the effect of making the orbits of electron beams greatly steady, and moreover the consumed electric powder increased by 1/100 or less as compared with the device of FIG. 2-1B.

We claim:

1. An electron-emitting device, comprising electrodes mutually opposingly provided in the surface of a substrate, and an electron-emitting area provided between said electrodes, wherein a conductive film having an electrical resistance greater than that of said electron-emitting area and not more than $10^{10}$ Ω/square is provided on the surface of the substrate at least at the peripheral area of said electron-emitting area in the state that is electrically connected to said electrodes.

2. The electron-emitting device according to claim 1, wherein said conductive film comprises a deposited film comprising a boride, a carbide, a nitride, a metal, a metal oxide, a semiconductor, or carbon, and having a specific resistance of $\rho<1\times10^4$ Ω·cm.

3. The electron-emitting device according to claim 2, wherein said conductive film has a film thickness t (cm) represented by the following relationship (1):

$$\rho/R_d>t>\rho\cdot10^{-10} \quad (1)$$

wherein $\rho$ represents specific resistance (Ω·cm) of the material used in said conductive film, and $R_d$ represents a sheet resistance (Ω/square) of said electron-emitting area.

4. The electron-emitting device according to claim 1, wherein said conductive film comprises a coated film comprising a boride, a carbide, a nitride, a metal oxide, a semiconductor, or carbon, and having a specific resistance of $\rho\geqq1\times10^4$ Ω·cm.

5. The electron-emitting device according to claim 1, wherein said electron-emitting area has an electrical resistance of from $1\times10^4$ to $1\times10^7$ Ω/square and said conductive film has an electrical resistance of from $1\times10^8$ to $1\times10^{10}$ Ω/square.

6. The electron-emitting device according to claim 1, wherein said substrate comprises an insulator.

7. An electron-base generator, comprising electrodes mutually opposingly provided on the surface of a substrate; an electron-emitting area provided between said electrodes; a conductive film having an electrical resistance greater than that of said electron-emitting area and not more than $10^{10}$ Ω/square, provided on the surface of the substrate at least at the peripheral area of said electron-emitting area in the state that it is electrically connected to said electrodes; and an electric source for applying a voltage between said electrodes.

8. The electron-beam generator according to claim 7, wherein said conductive film comprises a deposited film comprising a boride, a carbide, a nitride, a metal, a metal oxide, a semiconductor, or carbon, and having a specific resistance of $\rho<1\times10^4$ Ω·cm.

9. The electron-beam generator according to claim 8, wherein said conductive film has a film thickness t (cm) represented by the following relationship (1):

$$\rho/R_d>t>\rho\cdot10^{-10} \quad (1)$$

wherein $\rho$ represents specific resistance (Ω·cm) of the material used in said conductive film, and $R_d$ represents a sheet resistance (Ω/square) of said electron-emitting area.

10. The electron-beam generator according to claim 7, wherein said conductive film comprises a coated film comprising a boride, a carbide, a nitride, a metal oxide, a semiconductor, or carbon, and having a specific resistance of $\rho\geqq1\times10^4$ Ω·cm.

11. The electron-beam generator according to claim 7, wherein said electron-emitting area has an electrical resistance of from $1\times10^4$ to $1\times10^7$ Ω/square and said conductive film has an electrical resistance of from $1\times10^8$ to $1\times10^{10}$ Ω/square.

12. The electron-beam generator according to claim 7, wherein said substrate comprises an insulator.

* * * * *

UNITED STATES PATENT AND TRADEMARK OFFICE

CERTIFICATE OF CORRECTION

PATENT NO. : 4,954,744

DATED : September 4, 1990

INVENTOR(S) : HIDETOSHI SUZUKI ET AL.

It is certified that error appears in the above-identified patent and that said Letters Patent is hereby corrected as shown below: Title page:

AT [54] TITLE

"USE" should read --USE OF IT--.

COLUMN 1

Line 3, "MAKING USE" should read --MAKING USE OF IT--.
Line 14, "1965." should read --1965).--.
Line 17, "a" (second occurrence) should read --an--.
Line 32, "that;" should read --that:--.

COLUMN 3

Line 65, "above," should read --above--.

COLUMN 5

Line 22, "several" should read --a metal--.
Line 57, "thickness ti" should read --thickness t--.

COLUMN 6

Line 51, "procedures" should read --procedure--.

COLUMN 7

Line 2, "following" should read --followed--.
Line 13, "decompositioned" should read --decomposition--.

UNITED STATES PATENT AND TRADEMARK OFFICE

CERTIFICATE OF CORRECTION

PATENT NO. : 4,954,744

DATED : September 4, 1990

INVENTOR(S) : HIDETOSHI SUZUKI ET AL.

It is certified that error appears in the above-identified patent and that said Letters Patent is hereby corrected as shown below:

COLUMN 8

Line 34, "1'$10^{10}\Omega$/square," should read --1x$10^{10}\Omega$/square,--.
Line 43, "made" should read --make--.

COLUMN 11

Line 12, "ρapproximately" should read --ρ approximately--.
Line 21, "lifting-of" should read --lifting-off--.

COLUMN 12

Line 24, "a simple" should read --simple a--.

COLUMN 14

Line 30, "means" should read --beams--.

UNITED STATES PATENT AND TRADEMARK OFFICE

CERTIFICATE OF CORRECTION

PATENT NO. : 4,954,744

DATED : September 4, 1990

INVENTOR(S) : HIDETOSHI SUZUKI ET AL. Page 3 of 3

It is certified that error appears in the above-identified patent and that said Letters Patent is hereby corrected as shown below:

COLUMN 16

Line 13, "electron-base" should read --electron-beam--.

Signed and Sealed this

Tenth Day of November, 1992

*Attest:*

DOUGLAS B. COMER

*Attesting Officer*

*Acting Commissioner of Patents and Trademarks*